US006894436B2

(12) United States Patent
Togashi et al.

(10) Patent No.: US 6,894,436 B2
(45) Date of Patent: May 17, 2005

(54) DRIVE METHOD OF LIGHT-EMITTING DISPLAY PANEL AND ORGANIC EL DISPLAY DEVICE

(75) Inventors: Masato Togashi, Yonezawa (JP); Daisuke Fujita, Yonezawa (JP); Koji Henmi, Yonezawa (JP); Naoki Yazawa, Yonezawa (JP); Gen Suzuki, Yonezawa (JP); Keisuke Moriya, Yonezawa (JP)

(73) Assignee: Tohoku Pioneer Corporation, Yamagata (JP)

( * ) Notice: Subject to any disclaimer, the term of this patent is extended or adjusted under 35 U.S.C. 154(b) by 240 days.

(21) Appl. No.: 10/252,690

(22) Filed: Sep. 24, 2002

(65) Prior Publication Data

US 2003/0184237 A1 Oct. 2, 2003

(30) Foreign Application Priority Data

Mar. 28, 2002 (JP) ..... 2002-090704

(51) Int. Cl.[7] ..... G09G 3/10; G09G 3/34

(52) U.S. Cl. ..... 315/169.4; 315/169.3; 345/84; 345/82; 345/204

(58) Field of Search ..... 315/169.4, 169.1, 315/169.3; 345/84, 82, 76, 60, 204, 214, 77, 91, 74, 58, 55

(56) References Cited

U.S. PATENT DOCUMENTS 6,473,064 B1 * 10/2002 Tsuchida et al. ..... 345/82

FOREIGN PATENT DOCUMENTS

JP P2002-244612 * 8/2002
JP P2002-244616 * 8/2002

OTHER PUBLICATIONS

Patent Abstracts of Japan Publication No. 09–232074 dated Sep. 5, 1997.

* cited by examiner

*Primary Examiner*—Tuyet T. Vo
(74) *Attorney, Agent, or Firm*—Westerman, Hattori, Daniels & Adrian, LLP

(57) ABSTRACT

In a drive method of a light-emitting display panel capable of emitting light in low luminance, the parasitic capacitances of the light-emitting elements disposed in the light-emitting display panel are precharged making use of a reverse bias voltage before they are lit. In this case, a reverse bias voltage created by a reverse bias voltage creation circuit or a peak current being precharged is controlled by selectively grounding control terminals based on dimmer control. In particular, when the light-emitting elements are emitted in low luminance, the reverse bias voltage is output in a low level, thereby the light-emitting elements are prevented from being precharged with an excessive voltage. The above arrangement can realize light emission control in low luminance.

15 Claims, 8 Drawing Sheets

【FIG. 1】
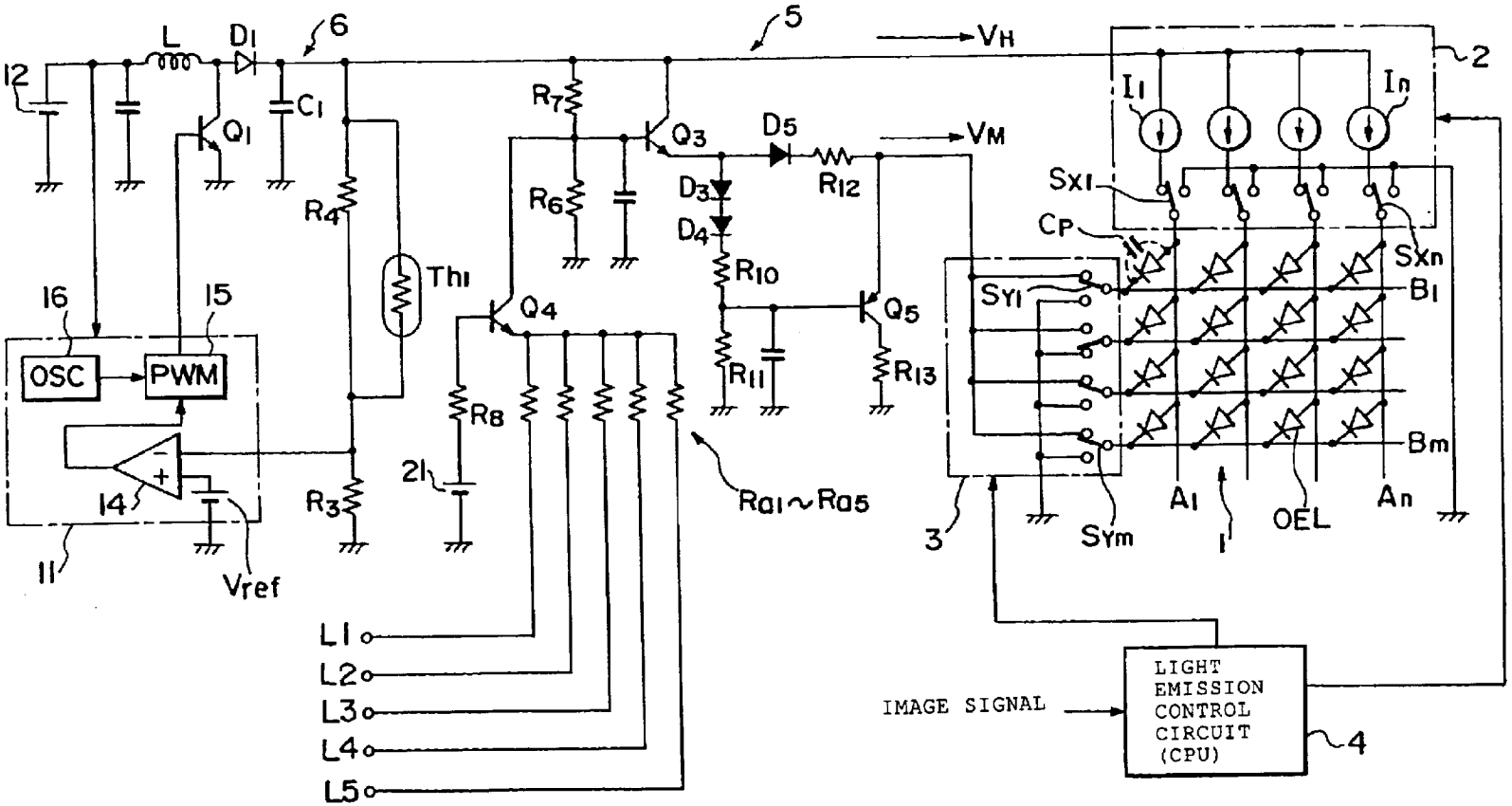

【FIG. 2】
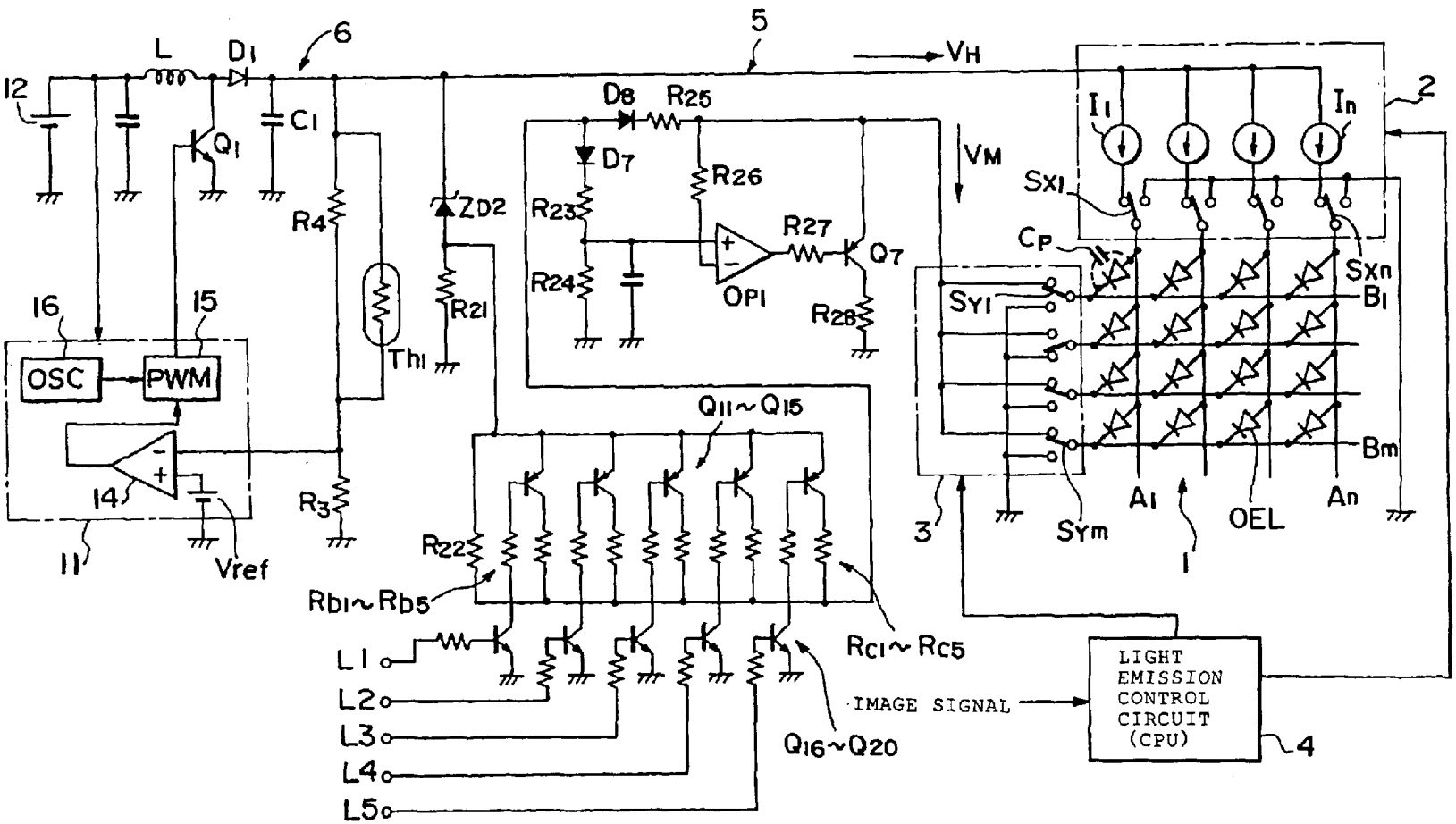

【FIG. 3】 【Prior Art】
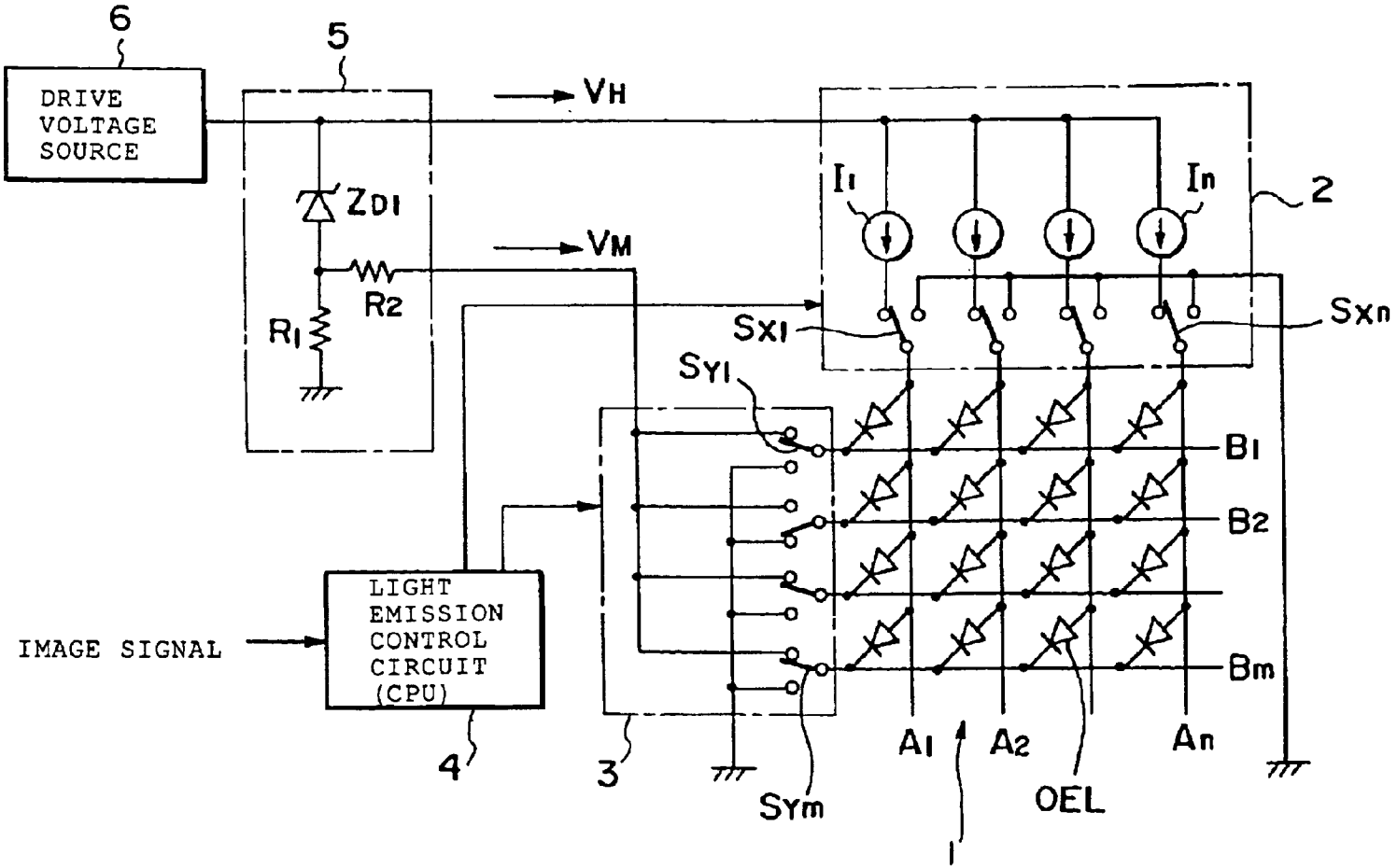

【FIG. 4】
【Prior Art】
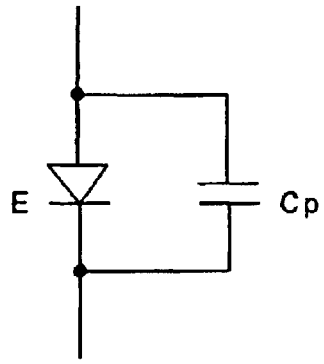
【FIG. 5】
【Prior Art】
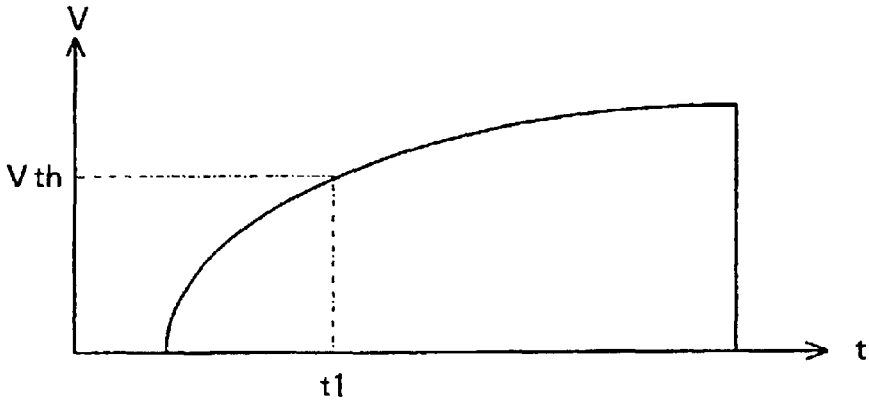

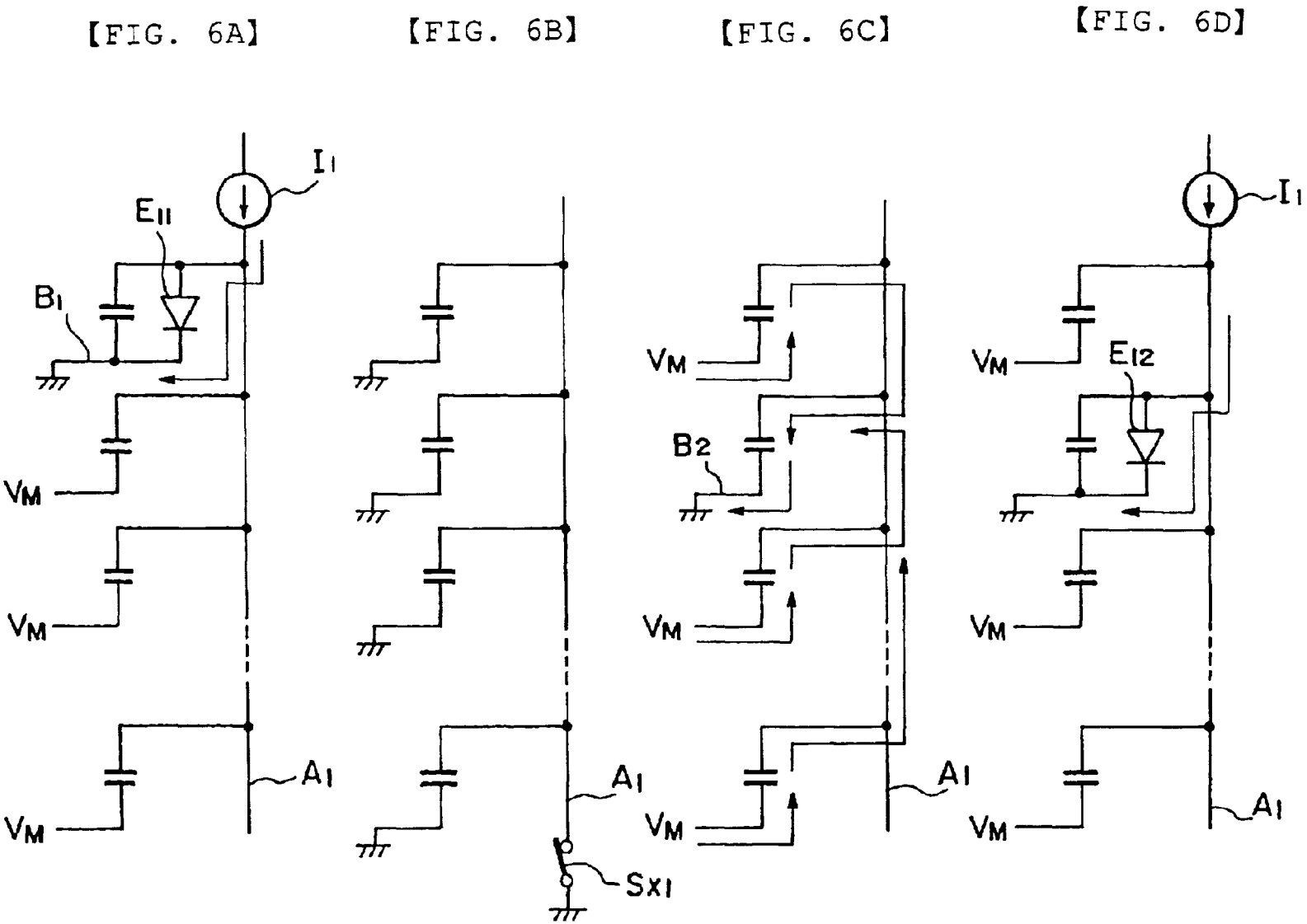
[FIG. 6A]
[FIG. 6B]
[FIG. 6C]
[FIG. 6D]
I1
E11
B1
VM
A1
SX1
B2
E12

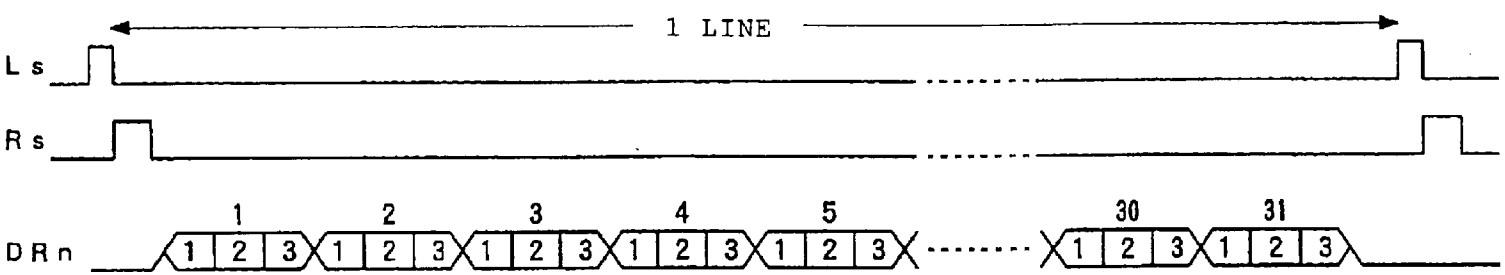
【FIG. 7A】
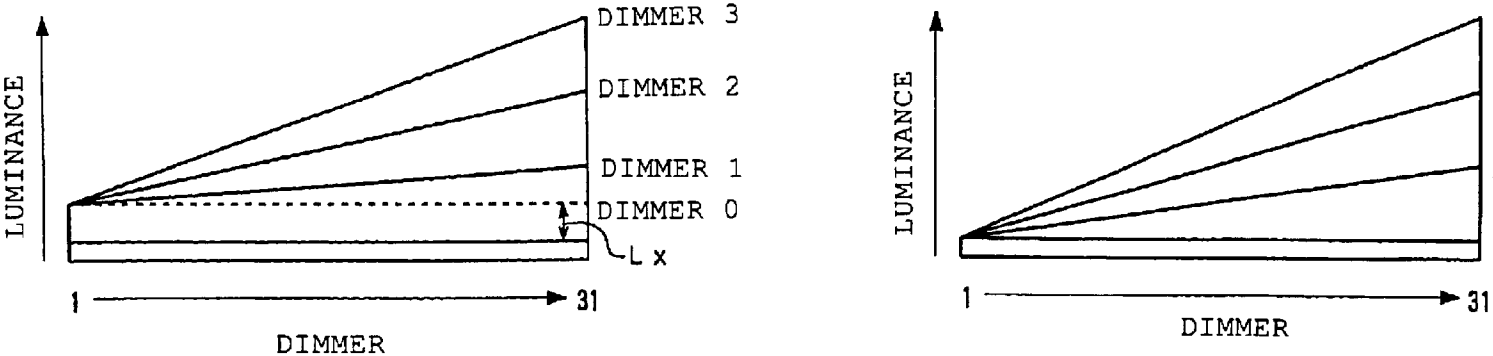
【FIG. 7B】
【FIG. 7C】

【FIG. 8】
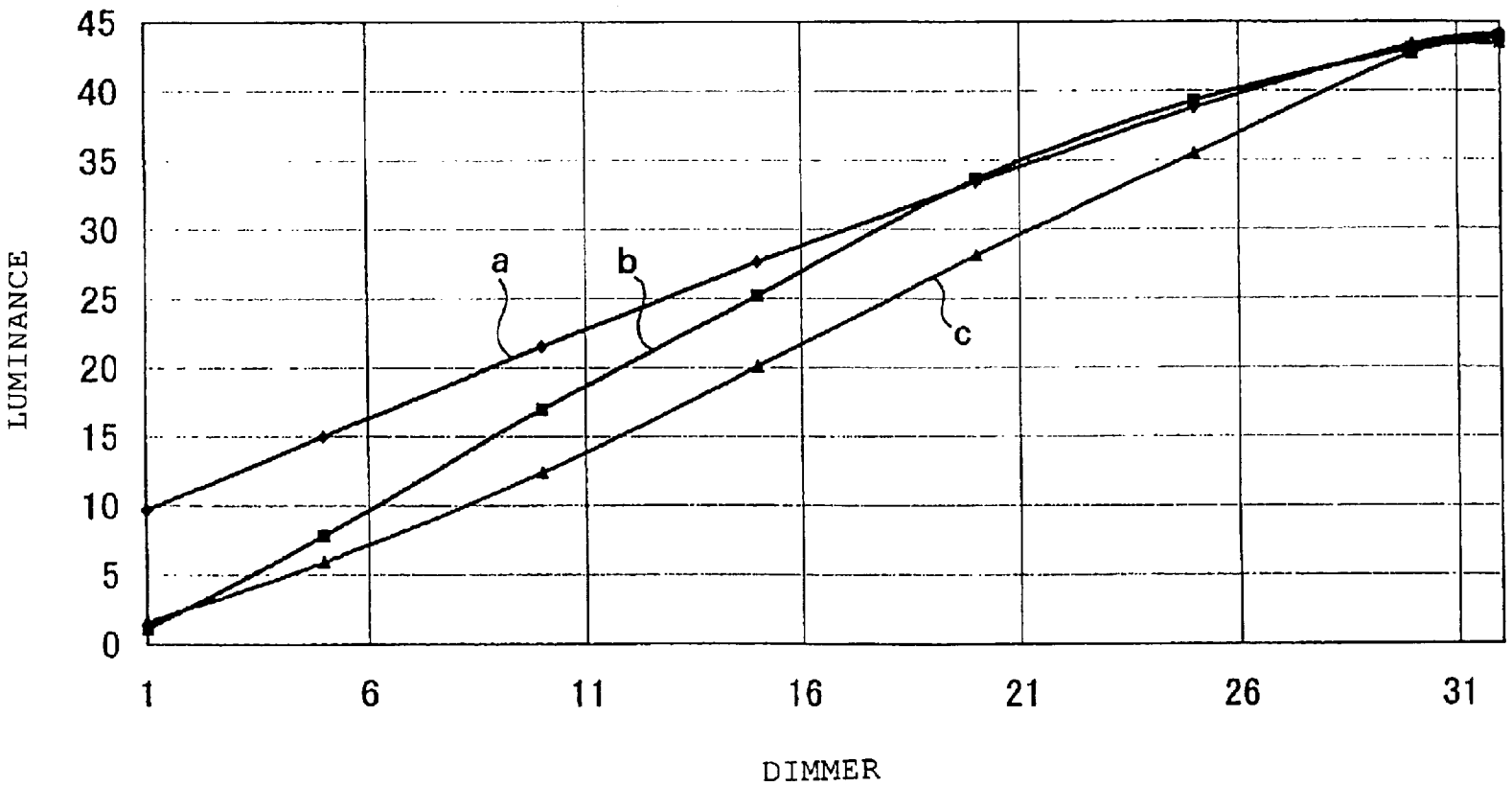

【FIG. 9】
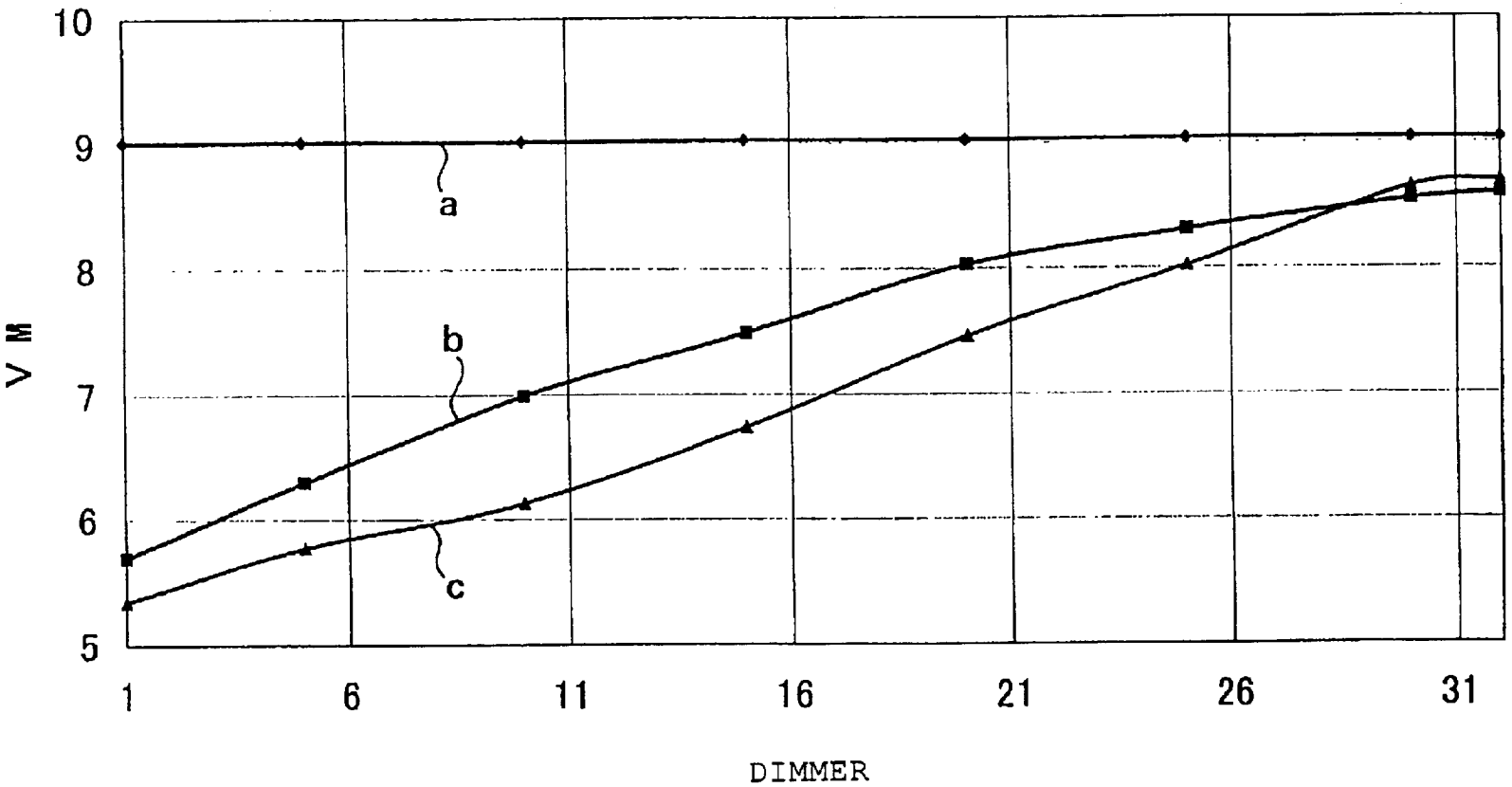

DRIVE METHOD OF LIGHT-EMITTING DISPLAY PANEL AND ORGANIC EL DISPLAY DEVICE

BACKGROUND OF THE INVENTION

1. Field of the Invention

The present invention relates to a drive method of a light-emitting display panel using, for example, organic electroluminescence (EL) elements as light-emitting elements and to a display device using the light-emitting display panel, and more particularly, to a control technology for controlling the luminance of the light-emitting display panel when it is lit.

2. Description of the Related Art

Attention is given to an organic EL display unit as a display unit replacing a liquid crystal display unit because the organic EL display unit can reduce power consumption, can display an image of high quality and further can be reduced in thickness. This is because the efficiency and life of the organic EL display unit have been improved to a practically usable level by using an organic compound promising good light emitting characteristics for the light-emitting layers of EL elements used in the EL display unit.

There has been proposed a passive matrix drive system as a drive method of a display panel in which the EL elements are disposed. FIG. 3 shows the passive matrix drive system and an example of the display panel whose light emission is controlled by the passive matrix drive system. Two drive methods, that is, a cathode line scan/anode line drive method and an anode line scan/cathode line drive method are available as a drive method of the EL elements in the passive matrix drive system. FIG. 3 shows the arrangement of the former cathode line scan/anode line drive method.

That is, the display panel 1 is arranged such that anode lines A1–An are disposed longitudinally as n-pieces of drive lines, whereas cathode lines B1–Bm are disposed laterally as m-pieces of scan lines, and organic EL elements OEL shown by the symbol of a diode are disposed at the intersections (n×m positions in total) of the respective lines. Then, the respective EL elements acting as light-emitting elements constituting pixels are disposed in a lattice shape, and one ends thereof (anode terminals of the EL elements) are connected to the anode lines and the other ends thereof (cathode terminals of the EL elements) are connected to the cathode lines in correspondence to the intersections of the vertical anode lines A1–An and the horizontal cathode lines B1–Bm. Further, the anode lines are connected to an anode line drive circuit 2, and the cathode lines are connected a cathode line scan circuit 3 so as to be driven respectively.

The anode line drive circuit 2 is provided with drive switches SX1–SXn in correspondence to the respective anode lines A1–An, and these drive switches Sx1–Sxn act to supply either the currents from constant current circuits I1–In or a ground potential to the anode lines corresponding to the respective anode lines A1–An. Accordingly, when the drive switches SX1–SXn are connected to the constant current circuit, they act to supply the currents from the constant current circuits I1–In to the respective EL elements disposed in correspondence to the cathode scan lines.

In contrast, the cathode line scan circuit 3 is provided with scan switches SY1–SYm in correspondence to the respective cathode scan lines B1–Bm, and any of the cathode scan lines B1–Bm being scanned is selectively connected to the ground potential acting as a reference potential. With this arrangement, the currents from the constant current circuits I1–In are supplied to the respective EL elements, which are disposed in correspondence to the cathode scan lines, through the drive switches Sx1–Sxn, thereby the EL elements are emitted.

In this case, a reverse bias current VM, which has a value near to the forward voltages of the EL elements being driven for light emission, is applied to the cathode lines other than the cathode line being scanned through the scan switches SY1–SYm, thereby the EL elements, which are not lit, are prevented from erroneously emitting light (crosstalk emission).

Note that it is possible to use a voltage source such as a constant voltage circuit, and the like in place of the constant current circuit I1–In. However, the constant current circuit shown in FIG. 3 is ordinarily used because of the reasons that the voltage/luminance characteristics of the EL elements are unstable to a temperature change while the current/luminance characteristics thereof are stable to the temperature change and that there is a possibility that the EL elements are deteriorated by an excessive current, and the like.

The anode line drive circuit 2 and the cathode line scan circuit 3 are connected to a light emission control circuit 4 including a CPU through control buses. The scan switches SY1–SYm and the drive switches SX1–SXn are manipulated based on the image signals of an image to be displayed. With this arrangement, the constant current circuits I1–In are appropriately connected to desired anode lines while setting the cathode scan lines to the ground potential at a predetermined cycle based on the image signals. Accordingly, the respective EL light-emitting elements selectively emit light, thereby the image is reproduced on the display panel 1 based on the image signals.

A DC output (output voltage=VH) from a drive voltage source 6 composed of, for example, a voltage increasing type DC-DC converter is supplied to the respective constant current circuits I1–In of the anode line drive circuit 2. With this arrangement, the constant currents created by the constant current circuits I1–In having received the output voltage VH from the drive voltage source 6 are supplied to the respective EL elements disposed in correspondence to the anode scan lines.

The reverse bias voltage VM used to prevent the crosstalk light emission of the EL elements is ordinarily generated by series regulating the output voltage VH because the value of the voltage VM is relatively near to the value of the output voltage VH and the current consumption of the reverse bias voltage VM is smaller than that the current consumption of the output voltage VH. It is considered that the employment of the above arrangement is advantageous from the view point of the number of parts and power consumption.

A reverse bias voltage creation circuit 5 arranged simply as shown in FIG. 3 can be preferably employed as a series regulating circuit. The reverse bias voltage creation circuit 5 receives the output voltage VH from the drive voltage source 6 at a series circuit composed of a constant voltage diode ZD1 and a resistor R1, and the reverse bias voltage VM is obtained from the terminal voltage of a resistor R1 via an output resistor R2. That is, the reverse bias voltage VM is obtained by subtracting a constant voltage determined by the constant voltage diode ZD1 from the output voltage VH.

It is known that the organic EL element described above has diode characteristics including a predetermined electric capacitance (parasitic capacitance) due to the laminated structure thereof. FIG. 4 shows an equivalent circuit of the organic EL element, and the equivalent circuit can be shown by a light-emitting element E having diode characteristics and a parasitic capacitance CP connected in parallel to the light-emitting element E.

Accordingly, when the organic EL element is driven by the constant current, the anode voltage waveform of the EL element rises up slowly because the constant current circuit is a high impedance output circuit in operation principle as shown in FIG. 5. That is, in FIG. 5, a vertical axis shows the anode voltage V of the element, and a lateral axis shows an elapsed time t.

The rising-up curve of the anode voltage V is changed by various conditions such as the lighting/non-lighting condition of the EL elements when they were scanned last time, the lighting/non-lighting condition of adjacent EL elements, and the like. In particular, the organic EL element emits light when the anode voltage thereof reaches a relatively high light emitting threshold voltage Vth. Accordingly, the luminance of the display panel is substantially dropped inevitably because the organic EL element emits light at a time t1 and thereafter (it does not emit light before the time t1 ).

To cope with this problem, there has been proposed a drive method of connecting a constant voltage source to an EL element when the EL element is driven for light emission and providing a precharge period for instantly charging the parasitic capacitance Cp of the EL element. There is a cathode reset method as a typical drive method of executing the precharge as disclosed in, for example, Japanese Patent Application Laid-Open No. 9-232074.

FIG. 6 explains a cathode reset method making use of the reverse bias voltage VM created in the drive circuit arranged as described above as the precharge voltage of a light-emitting element. A cathode reset operation is executed by driving the drive switches SX1–SXn in the anode line drive circuit 2 or the scan switches SY1–SYm in the cathode line scan circuit 3 in response to the control signal from the light emission control circuit 4 shown in FIG. 3.

Note that FIGS. 6A–6D show, for example, from a state in which an EL element E11 connected to the first anode drive line A1 is driven for light emission to a state in which an EL element E12 connected to the first anode drive line A1 likewise is driven for light emission in the next scan. In FIG. 6, EL elements being driven for light emission are shown by a symbol mark of a diode and the other EL elements are shown by a symbol mark of a capacitor.

FIG. 6A shows a state before the cathode reset operation is executed in which the cathode scan line B1 is scanned and the EL element E11 is emitted. The EL element E12 is emitted in the next scan. However, before the EL element E12 is emitted, the anode drive line A1 and all the cathode scan lines B1–Bm are reset to the ground potential as shown in FIG. 6B to thereby discharge all the charges. This is executed by connecting the respective scan switches SY1–SYm shown in FIG. 3 to the ground as well as by connecting the drive switch SX1 connected to the first drive line A1 to the ground.

Next, the cathode scan line B2 is scanned to emit the EL element E12. That is, the cathode scan line B2 is connected to the ground, and the reverse bias voltage VM is applied to the cathode scan lines other than the cathode scan line B2. Note that, at this time, the drive switch SX1 is isolated from the ground and connected to the constant current circuit I1.

Since the charges of the parasitic capacitances of the respective EL elements have been discharged in the above reset operation shown in FIG. 6B, the parasitic capacitances of the EL elements other than the EL element E12 which is emitted next are charged with the reverse bias voltage VM in a reverse direction as shown by arrows in FIG. 6C at the moment, and the currents charged to these parasitic capacitances flow to the EL element E12 which is emitted next through the anode drive line A1 and charges (precharges) the parasitic capacitance of the EL element E12. At this time, the constant current circuit I1 connected to the drive line A1 is basically the high impedance circuit as described above and does not influence the behavior of the charged current.

In this case, when it is assumed that 64 EL elements, for example, are disposed to the anode drive line A1 and that the above reverse bias voltage VM is 9 V, the potential V (A1) of the anode drive line A1 instantly rises up to the potential shown in the following equation 1 due to the above charge operation because the wiring impedance in the display panel is too small to ignore. For example, in a display, panel having an outside dimension set to 100 mm×25 mm (256×64 dots), this operation is completed in about 1 $\mu$sec.

$$V(A1)=(VM\times 63+0V\times 1)/64=8.86V \quad \text{[Formula 1]}$$

Thereafter, the EL element E12 is caused to instantly emit light as shown in FIG. 6D by the drive current that flows from the constant current circuit I1 to the anode drive line A1. As described above, the cathode reset method acts to instantly rises up the forward voltage of the EL element that is drive for light emission next making use of the parasitic capacitance CP of the EL element that essentially obstructs the drive thereof and the reverse bias voltage VM for preventing the crosstalk light emission.

Incidentally, the display device that is driven for light emission by the above arrangement is provided with a gradation control function and a dimmer control function for controlling the display luminance thereof. The former gradation control function mainly controls the luminance of each EL element for each dot. Further, the latter dimmer control function mainly controls the overall luminance of the display panel uniformly. When the dimmer control function is employed in a device for automobile use, it is used to control overall luminance in accordance with the outside light in the daytime and at night.

FIG. 7A exemplifies a case in which the gradation and dimmer control are executed by controlling gradation in 4 stages dimmer in 32 stages, respectively. That is, in a display device shown in FIG. 7A, the cathode reset Rs described above is executed in synchronism with a line sink Ls showing one line of display as well as the gradation and dimmer control is executed in the remaining period subsequent to the cathode reset Rs.

As shown in FIG. 7A, the light-emitting elements are lit by time division during the control period DRn in which the gradation and dimmer control is executed. Note that the upper numerals in FIG. 7A show the lighting control executed by the dimmer control and the lower numerals show the lighting control executed by the gradation control. That is, the number of stages of gradation D is set to 0–3 stages and the number of stages of dimmer L is set to 0–31 stages, and the lighting drive period of the EL elements is divided into 3×31=93. Then, currents are supplied to the EL elements from the constant current circuits as many as the number of D×L to thereby execute the gradation and dimmer control.

When, for example, the gradation is set to 3 and the dimmer is set to 31, any relevant EL elements are lit during all the periods. Further, when, for example, the gradation is set to 3 and the dimmer is set to 30 stages, the EL elements are not lit during the period shown by 31 in FIG. 7A. Further, when, for example, the gradation is set to 2 and the dimmer is set to 31, the EL elements are lit during only the periods 1 and 2 in the lower numerals. With this operation, the light emitting times of the EL elements being lit and displayed are controlled, thereby the light emitting luminance of the display panel is controlled.

Incidentally, when the EL elements start to be lit, the voltage near to the reverse bias voltage VM is precharged to the parasitic capacitances of the EL elements by the above cathode reset. Accordingly, when a case in which the dimmer is set to, for example, 1 is taken into consideration, a problem is arisen in that the display panel is driven and lit with a certain degree of light emission luminance LX. This is because a voltage, which permits the EL elements to be sufficiently emitted, has been precharged to the EL elements by the cathode reset operation as shown in FIG. 7B regardless of the requirement for essentially controlling the EL elements to reduce the light emission luminance thereof to a very low level.

FIG. 8 is a graph showing an example of the light emission luminance, in which a lateral axis shows the number of stages of dimmer and a vertical axis shows light emission luminance (cd=candela). Note that the characteristics shown in FIG. 8 show a case in which the gradation is set to 3. Even if the dimmer is set to 1 as shown as characteristics "a" in FIG. 8, the EL elements emit light with luminance of about 10 cd. Then, when the dimmer is set to 1, the EL elements are not lit.

Accordingly, the luminance is greatly changed between a case in which the EL elements are not lit and a case in which the dimmer is set to 1. Further, a rate of change of luminance is relatively small between a case in which the dimmer is set to 1 and a case in which the dimmer is set to 31 to cause the EL elements to be lit with maximum luminance. This drawback is caused by that the reverse bias voltage VM is set (fixed) to an approximately constant value regardless of that the dimmer is set to various values.

SUMMARY OF THE INVENTION

An object of the present invention, which was made based on the above technical point of view, is to provide a drive method of a light-emitting display panel capable of controlling light emission and in particular light emission in low luminance by dimmer or gradation control and capable of increasing the control range, that is, the dynamic range of the light emission luminance of EL elements by the dimmer or gradation control and to provide an organic EL display device using the control method.

In a drive method, which was made to realize the above object, of a light-emitting display panel having a plurality of drive lines and a plurality of scan lines intersecting one another, and a plurality of capacitive light-emitting elements connected between the respective drive lines and the respective scan lines at the positions at which the drive lines intersect the scan lines, the drive method includes the step of changing, when the capacitive light-emitting elements constituting the light-emitting display panel start to emit light, one of a charge voltage and a charge peak current for precharging the parasitic capacitances of the light-emitting elements is changed according to the controlled state of the light emission luminance of the light-emitting elements.

In this case it is preferable that the charge voltage for precharging the parasitic capacitances of the light light-emitting elements be changed from a low voltage to a high voltage as the light emission luminance of the light-emitting elements is controlled from low luminance to high luminance. Then, a reverse bias voltage for applying a reverse bias to the light-emitting elements in a non-scan state is preferably used as the charge voltage for precharging the parasitic capacitances of the light-emitting elements.

In this case, it is preferable that precharge means for precharging the parasitic capacitances of the light-emitting elements execute a reset operation for resetting the voltages of both the terminals of the respective light-emitting elements to the same potential once when a scan is switched to the next scan and execute a charge operation subsequent to the reset operation for charging a charge current resulting from the reverse bias voltage to the parasitic capacitances of the light-emitting elements that are to be lit next via the parasitic capacitances of the other light-emitting elements commonly connected to the above drive lines together with the light-emitting elements.

In contrast, it is preferable that the light emission luminance of the light-emitting elements be controlled by the lighting time of the light-emitting elements that are lit and displayed in one scan period. In a preferred embodiment, the reverse bias voltage for precharging the parasitic capacitances of the light-emitting elements may be created based on the voltage output from a drive voltage source for driving constant current circuits for applying constant currents to the respective drive lines.

In addition to the above, in the preferred embodiment, the reverse bias voltage for precharging the parasitic capacitances of the light-emitting elements may be obtained by dividing the voltage output from the drive voltage source based on a degree of control of the light emission luminance of the light-emitting elements. Further, a voltage increasing type DC-DC converter is preferably used as the drive voltage source.

In the display device according to the present invention, organic EL elements are used as the light-emitting elements and driven for light emission by employing the above drive method.

According to the display device employing the above drive method, when the capacitive light-emitting elements constituting the light-emitting display panel start light emission, the charge voltage for precharging the parasitic capacitances of the light-emitting elements is changed according to the controlled state of light emission luminance of the EL elements. That is, when the light emission luminance in the light-emitting elements is controlled in relatively low luminance, the parasitic capacitances of the light-emitting elements are charged with a relatively low voltage.

With this operation, the parasitic capacitances of the light-emitting elements that are driven for light emission next are prevented from being charged with an excessive voltage, thereby light emission control can be realized in low luminance. In other words, the control range, that is, the dynamic range of the light emission luminance of the EL elements which is controlled by the dimmer or gradation control can be increased.

When the parasitic capacitances of the light-emitting elements are precharged by the cathode reset means making use of the reverse bias voltage for applying the reverse bias to the light-emitting elements in the non-scan state, the drive circuit of the light-emitting display panel can be simply arranged.

In this case, the reverse bias voltage for precharging the parasitic capacitances of the light-emitting elements may be obtained by dividing the voltage output from the drive voltage source based on a degree of control of the light emission luminance of the light-emitting elements. Accordingly, when this means is employed, a precharge voltage, which is most suitable in accordance with a control state of light emission luminance, can be easily obtained.

BRIEF DESCRIPTION OF THE DRAWINGS

FIG. 1 is a wiring diagram showing a first embodiment of a light emission drive device employing a drive method according to the present invention;

FIG. 2 is a wiring diagram showing a second embodiment of the light emission drive device employing the drive method according to the present invention;

FIG. 3 is a wiring diagram showing an example of a conventional light emission drive device;

FIG. 4 is an equivalent circuit diagram of an organic EL element;

FIG. 5 is a characteristic graph showing a rising-up state of an anode voltage in an organic EL element when it is driven by a constant current;

FIGS. 6A, 6B, 6C, and 6D are circuit diagrams explaining a cathode reset operation;

FIG. 7A is a timing chart when the gradation and dimmer control is executed, and FIGS. 7B and 7C are characteristic views showing a relationship among luminance, gradation, and dimmer;

FIG. 8 is a graph showing a relationship between dimmer and luminance; and

FIG. 9 is a graph showing a relationship between dimmer and a reverse bias voltage.

DESCRIPTION OF THE PREFERRED EMBODIMENTS

A preferable embodiment of a display device employing a drive method according to the present invention will be explained with reference to the drawings. FIG. 1 shows a drive circuit to which the present invention is applied and a first embodiment of a display panel whose light emission is controlled by the drive circuit. Note that, in FIG. 1, a display panel 1, an anode line drive circuit 2, a cathode line scan drive circuit 3, and a light emission control circuit 4 that drive the display panel 1 have the same functions as those of the respective circuits shown in FIG. 3 described above, and thus the detailed description thereof is appropriately omitted.

In the first embodiment shown in FIG. 1, a DC-DC converter is used as a drive voltage source 6. Note that while the DC-DC converter described below creates a direct current output (output voltage=VH) by PWM (pulse width modulation) control, it may utilize PFM (pulse frequency modulation) control.

The DC-DC converter is arranged such that an npn transistor Q1 acting as a switching element is turned on at a predetermined duty cycle in response to a PWM wave supplied from a switching regulator circuit 11. That is, the electric power energy from a direct current voltage source 12 is accumulated in an inductor L by turning on the transistor Q1, whereas the electric power energy accumulated in the inductor L is accumulated in a capacitor C1 via a diode D1 by turning off the transistor Q1. Then, an increased DC output can be obtained as the terminal voltage of the capacitor C1 by repeatedly turning on and off the transistor Q1.

The DC output voltage is divided at the point at which a resistor R3 is connected in series to a parallel circuit composed of a resistor R4 and a temperature compensating thermistor Th1 and supplied to an error amplifier 14 in the switching regulator circuit 11. The error amplifier 14 creates an error output by comparing the divided DC output voltage with a reference voltage Vref supplied thereto and supplies the error output to a PWM circuit 15. With this operation, the output voltage VH is maintained to a predetermined constant voltage by controlling the duty of the signal wave supplied from a reference oscillator 16.

The reverse bias voltage VM, which is used to prevent the crosstalk light emission of EL elements, can be obtained by series regulating the output voltage VH obtained from the DC-DC converter. Note that, in the first embodiment, the reverse bias voltage VM is used as a charge voltage source for precharging the parasitic capacitances Cp of organic EL elements by simultaneously using the cathode reset method whose operation was described above with reference to FIG. 6.

A reverse bias voltage creation circuit 5 for creating the reverse bias voltage VM is provided with resistors R6 and R7 for dividing the output voltage VH, and the base of a transistor Q3 is connected to the point at which the resistor R6 is connected to the resistor R7. The collector of the transistor Q3 is connected to the output line of the drive voltage source 6 composed of the DC-DC converter, thereby the transistor Q3 constitutes an emitter follower for subjecting the divided voltage to impedance transformation.

In the voltage division circuit composed of the resistors R6 and R7, pull-down resistors Ra1–Ra5 having an npn transistor Q4 is connected in parallel to the resistor R6. That is, the collector of the transistor Q4 is connected to the point at which the resistor R6 is connected to the resistor R7, and the voltage from a bias voltage source 21 is supplied to the base of the transistor Q4 via a resistor R 8. Further, the pull-down resistors Ra1–Ra5, which are connected in parallel to each other, are connected to the emitter of the transistor Q4, and the other ends of the pull-down resistors Ra1–Ra5 constitute control terminals L1–L5 which are selectively connected to the reference voltage (ground).

According to the above arrangement, the collector current of the transistor Q4 can be controlled in five bits (32 stages) by appropriately selecting the values of the pull-down resistors Ra1–Ra5 connected to the emitter of the transistor Q4 and by selecting a combination of the grounded ones of the control terminals L1–L5. In the first embodiment, gradation is controlled in 4 stages and dimmer is controlled in 32 stages as described above with reference to FIG. 7A. Accordingly, the collector current of the transistor Q4 can be controlled in 32 stages by selecting a combination of the grounded ones of the control terminals L1–L5 based on a value to which the dimmer is set. Actually, the control terminals L1–L5 are operated such that none of the control terminals L1–L5 are grounded when the dimmer is set to a maximum value (32), all of the control terminals L1–L5 are grounded when the dimmer is set to a minimum value (1), and control terminals L1–L5 to be grounded are selected in respective combinations when the dimmer is set between 2 and 31, thereby the dimmer is controlled in all the 32 stages.

Thus, according to the above arrangement, the collector current (suction current) of the transistor Q4 can be controlled based on a value to which the dimmer is set, which results in a variable impedance circuit connected in parallel to the resistor R6 so as to vary impedance in the 32 stages based on the value to which the dimmer is set. With this arrangement, the voltage divided by the resistor R7 and the parallel circuit, which is composed of the resistor R6 and the variable impedance circuit and connected in parallel to the resistor R7 and, is supplied to the base of the transistor Q3 constituting the emitter follower.

A voltage division circuit, which is composed of diodes D3 and D4 and resistors R10 and R11, is connected to the emitter of the transistor Q3, and the divided voltage output from the point at which the resistor R10 is connected to the resistor R11 is supplied to the base of a pnp transistor Q5. The collector of the transistor Q5 is grounded via a resistor R13, and the output from the emitter of the transistor Q3 is supplied to the emitter of the transistor Q5 through a diode D5 and a resistor R12. The potential of the emitter of the transistor Q5 is used as the reverse bias voltage VM (precharge voltage).

The transistor Q5 ordinarily acts to maintain a turned-off state by a relationship between the base voltage, which is obtained by the voltage division circuit composed of the diodes D3 and D4 and the resistors R10 and R11, and the emitter voltage dropped by the diode D5 and the resistor R12. In contrast, when, for example, the light-emitting elements of the display panel is driven for light emission, a phenomenon arises in that anode drive voltages flow to the reverse bias voltage creation circuit 5 through the parasitic capacitances of the light-emitting elements. As a result, the reverse bias voltage VM is boosted (increased).

When the reverse bias voltage VM is boosted by the above operation, the emitter voltage of the transistor Q5 is shifted up, thereby the transistor Q5 is conducted so as to suck a current from the emitter thereof to the collector thereof. That is, the transistor Q5 exerts a voltage clamp function for preventing the emitter voltage thereof from being shifted up. With this operation, in an image displayed in a state in which, for example, a scan for lighting all the light-emitting elements and a scan for lighting a part of the light-emitting elements are mixed, the occurrence of horizontal crosstalk in which a partly lighting scan region is dark because the boosted amount of the reverse bias voltage VM in the partly lighting scan region is smaller than that in the entirely lighting scan region.

According to the arrangement shown in FIG. 1 described above, the reverse bias voltage VM, which is obtained by the reverse bias voltage creation circuit 5, is used as a precharge voltage for precharging the parasitic capacitances of the light-emitting elements that are driven for light emission next. At this time, the reverse bias voltage VM is changed according to a value of the dimmer set by a dimmer control means. In this case, as the value of the dimmer is set from low luminance to high luminance, the reverse bias voltage VM is changed from a low voltage to a high voltage.

Accordingly, when attention is paid particularly to the case in which the value of the dimmer is set to the low luminance, the level of the precharge voltage making use of the reverse bias voltage VM is also reduced. Thus, the parasitic capacitances of the EL elements, which are driven for light emission next, are prevented from being charged with an excessive voltage. FIG. 7C shows the above case. That is, it is possible in FIG. 7C to prevent the state in which the minimum luminance has been risen up by an excessive precharge voltage (rising-up light emission luminance Lx) as shown in FIG. 7B described above. With this arrangement, a large change of luminance can be eliminated between the case in which the EL elements are not lit and the case in which the dimmer is set to 1. In other words, the control range, that is, the dynamic range of the luminance when the EL elements are lit can be increased by the dimmer or gradation control.

Note that the characteristics shown by "b" in FIG. 8 show a case which is executed by the drive circuit shown in FIG. 1 and in which the gradation is set to 3 likewise. When the dimmer is set to 1 as shown by "b" in FIG. 8, the light emission luminance of the EL elements is set to about 1 cd. The characteristics "b" shown in FIG. 9 show the characteristics of change of the reverse bias voltage VM (precharge voltage) corresponding to the value set to the dimmer in the drive circuit shown in FIG. 1.

Next, FIG. 2 shows a second embodiment of the drive circuit to which the present invention is applied. Note that, in FIG. 2, a display panel 1, an anode line drive circuit 2, a cathode line scan circuit 3, and a light emission control circuit 4 for driving the display panel as well as a drive voltage source 6 composed of DC-DC converter have the same functions as those of the respective circuits shown in FIG. 1 described above, and thus the detailed description thereof is appropriately omitted.

In the drive circuit shown in FIG. 2, a reverse bias voltage creation circuit 5 creates the reverse bias voltage VM making use of the output voltage VH obtained by the DC-DC converter similarly to the first embodiment. The reverse bias voltage VM is used as a charge voltage source for precharging the parasitic capacitances Cp of organic EL elements by simultaneously using the cathode reset method described above with reference to FIG. 6 also in the second embodiment.

As shown in FIG. 2, the reverse bias voltage creation circuit 5 is provided with a series circuit composed of a constant voltage diode ZD2 for receiving the output voltage VH output from a drive voltage source 6 and a resistor R21 and obtains a divided voltage output from the point at which the diode ZD2 is connected to the resistor R21. That is, the divided voltage output is obtained by subtracting a constant voltage determined by the diode ZD2 from the output voltage VH.

Then, an end of a resistor R22 is connected to the point at which the diode ZD2 is connected to the resistor R21 as well as a series circuit, which is composed of pnp transistors Q11–Q15 and resistors Rc1–Rc5, is connected in parallel to the resistor R22. One ends of resistors Rb1–Rb5 are connected to the bases of the pnp transistors Q11–Q15 as well as the other ends of the resistors Rb1–Rb5 are connected to the collectors of pnp transistors Q16–Q20 whose emitters are grounded, respectively. Further, the bases of the transistors Q16–Q20 are connected to control terminals L1–L5 through the resistors, respectively.

The transistors Q16–Q20 act as switching elements that are turned on when a positive voltage (+) is selectively applied to the control terminals L1–L5, thereby the respective transistors Q11–Q15 are turned on. Accordingly, a parallel composite impedance of the resistor R22 and the resistors Rc1–Rc5 can be controlled in 5 bits (32 stages) by appropriately selecting the values of the resistors Rc1–Rc5 connected in series to the respective transistors Q11–Q15 and by selecting a combination of the control terminals L1–L5 to which the positive voltage is applied.

The gradation is controlled in 4 stages and the dimmer is controlled in the 32 stages also in the second embodiment as described above with reference to FIG. 7A. Accordingly, the potential level of the resistor R22 on the side thereof at which it is connected to the diode D7 can be controlled in the 32 stages by selecting a combination of the control terminals L1–L5 to which the positive voltage is applied based on the setting of the dimmer. In other words, it is nothing else that when the reverse bias voltage is applied, a value of a peak voltage being precharged can be controlled in the 32 stages.

A voltage division circuit, which is composed of a diode D7 and resistors R23 and R24, is connected to the other end of the resistor R22, and the divided voltage output from the point at which the resistor R23 is connected to the resistor R24 is supplied to the non-inverted input terminal of an operational amplifier Op1. Further, a diode D8 and a resistor R25 are connected in series to the other end of the resistor R22, and further the output from the resistor R25 is supplied to the inverted input terminal of the operational amplifier Op1.

The emitter of a pnp transistor Q7 is connected to the point at which the resistor R25 is connected to the resistor R26, and the collector of the transistor Q7 is grounded through a resistor R28. Further, the output from the operational amplifier Op1 is supplied to the base of the transistor Q7 through a resistor R27. Then, the potential of the emitter of the transistor Q7 is used as the reverse bias voltage VM (precharge voltage).

The operational amplifier Op1 ordinarily generates a positive (+) output, thereby the transistor Q7 is in a cut-off state. In contrast, when the reverse bias voltage VM is boosted (increased) by anode drive currents through the parasitic capacitances of the light-emitting elements as described in the arrangement of FIG. 1, the potential level of the inverted input terminal of the operational amplifier Op1 is increased, thereby the output from the operational amplifier Op1 is inverted to a negative (−) output.

With this operation, the transistor Q7 is conducted and acts to suck a current from the emitter thereof to the collector thereof. That is, the transistor Q7 exerts a voltage clamp function for preventing the emitter voltage thereof from being shifted up. With this function, the occurrence of horizontal crosstalk can be prevented as described as to the arrangement shown in FIG. 1.

According to the circuit arrangement shown in FIG. 2 described above, the reverse bias voltage VM, which is obtained by the reverse bias voltage creation circuit 5 similarly to the arrangement shown in FIG. 1, is used as the precharge voltage for precharging the parasitic capacitances of the light-emitting elements that are driven for light emission next by the operation of the cathode reset. At this time, the reverse bias voltage VM is changed according to a value of the dimmer set by a dimmer control unit in the same way.

Accordingly, when the value of the dimmer is set particularly to low luminance, the parasitic capacitances of the EL elements, which are driven for light emission next, are prevented from being charged with an excessive voltage. Thus, the control mode shown in FIG. 7A described above can be realized also in the circuit arrangement shown in FIG. 2.

Note that the characteristics shown by "c" in FIG. 8 show a case which is executed by the drive circuit shown in FIG. 2 and in which the gradation is set to 3 likewise. When the dimmer is set to 1 as in the characteristics shown as "c" in FIG. 8, the light emission luminance of the EL elements is set to about 1 cd. Further, according to the drive circuit shown in FIG. 2, it can be found that the light emission luminance corresponding to the value set to the dimmer is more linearly changed than that in the circuit arrangement shown in FIG. 1. The characteristics "c" shown in FIG. 9 show the characteristics of change of the reverse bias voltage VM (precharge voltage) corresponding to the value set to the dimmer in the drive circuit shown in FIG. 2.

While the dimmer and gradation control is realized by changing the lighting time of the EL elements in the examples described above, the dimmer and gradation control also can be realized by controlling the currents output from constant current circuits I1–In provided with the anode line drive circuit 2. Accordingly, when the output currents are controlled as described, the control terminals L1–L5 are selectively grounded or the positive voltage is selectively applied to the control terminals L1–L5 in correspondence to the control of the currents output from the constant current circuits I1–In.

As apparent from the above description, according to the display device making use of the drive method according to the present invention, when capacitive light-emitting elements such as the organic EL elements start light emission, the charge voltage for precharging the light-emitting elements is changed according to the controlled state of the light emission luminance of the light-emitting elements, thereby light emitting characteristics of lower luminance can be secured. Accordingly, it is possible to more increase the control range, that is, the dynamic range of the luminance of the light-emitting elements.

What is claimed is:

1. A drive method of a light-emitting display panel comprising a plurality of drive lines and a plurality of scan lines intersecting said drive lines, and a plurality of capacitive light-emitting elements connected between the respective drive lines and the respective scan lines at the positions at which the drive lines intersect the scan lines, comprising the step of:

changing, when the capacitive light-emitting elements constituting the light-emitting display panel start to emit light, a charge voltage, that is, a charge peak current for precharging the parasitic capacitances of the light-emitting elements according to the controlled state of the light emission luminance of the light-emitting elements.

2. The drive method of a light-emitting display panel according to claim 1, wherein the charge voltage for precharging the parasitic capacitances of the light-emitting elements is changed from a low voltage to a high voltage as the light emission luminance of the light-emitting elements is controlled from low luminance to high luminance.

3. The drive method of a light-emitting display panel according to claim 1, wherein a reverse bias voltage for applying a reverse bias to the light-emitting elements in a non-scan state is used as the charge voltage for precharging the parasitic capacitances of the light-emitting elements.

4. The drive method of a light-emitting display panel according to claim 2, wherein a reverse bias voltage for applying a reverse bias to the light-emitting elements in a non-scan state is used as the charge voltage for precharging the parasitic capacitances of the light-emitting elements.

5. The drive method of a light-emitting display panel according to claim 3, wherein precharge means for precharging the parasitic capacitances of the light-emitting elements executes a reset operation for resetting the voltages of both the terminals of the respective light-emitting elements to the same potential once when a scan is switched to the next scan and executes a charge operation subsequent to the reset operation for charging a charge current resulting from the reverse bias voltage to the parasitic capacitances of the light-emitting elements that are to be lit next via the parasitic capacitances of the other light-emitting elements commonly connected to the above drive lines together with the light-emitting elements.

6. The drive method of a light-emitting display panel according to claim 1, wherein the light emission luminance of the light-emitting elements is controlled by the lighting time of the light-emitting elements that are lit and displayed in one scan period.

7. An organic EL display device, wherein the light-emitting elements comprise organic EL elements driven for light emission by the drive method according to any one of claims 1 to 6.

8. The drive method of a light-emitting display panel according to claim 3 or 4, wherein the reverse bias voltage for precharging the parasitic capacitances of the light-emitting elements is created based on the voltage output from a drive voltage source for driving constant current circuits for applying constant currents to the respective drive lines.

9. An organic EL display device, wherein the light-emitting elements comprise organic EL elements driven for light emission by the drive method according to claim 8.

10. The drive method of a light-emitting display panel according to claim 8, wherein a voltage increasing type DC-DC converter is used as the drive voltage source.

11. An organic EL display device, wherein the light-emitting elements comprise organic EL elements driven for light emission by the drive method according to claim 10.

12. The drive method of a light-emitting display panel according to claim 8, wherein the reverse bias voltage for precharging the parasitic capacitances of the light-emitting elements is obtained by dividing the voltage output from the drive voltage source based on a degree of control of the light emission luminance of the light-emitting elements.

13. An organic EL display device, wherein the light-emitting elements comprise organic EL elements driven for light emission by the drive method according to claim 12.

14. The drive method of a light-emitting display panel according to claim 12, wherein a voltage increasing type DC-DC converter is used as the drive voltage source.

15. An organic EL display device, wherein the light-emitting elements comprise organic EL elements driven for light emission by the drive method according to claim 14.

* * * * *